US008117947B2

(12) United States Patent
Chiang

(10) Patent No.: US 8,117,947 B2
(45) Date of Patent: Feb. 21, 2012

(54) POWER RATCHET ASSEMBLY

(75) Inventor: Hsu-Huan Chiang, Dali (TW)

(73) Assignee: Jetly Professional Air Tools Co., Ltd., Dali, Taichung County (TW)

( * ) Notice: Subject to any disclaimer, the term of this patent is extended or adjusted under 35 U.S.C. 154(b) by 314 days.

(21) Appl. No.: 12/629,226

(22) Filed: Dec. 2, 2009

(65) Prior Publication Data

US 2011/0126676 A1 Jun. 2, 2011

(51) Int. Cl.
*B25B 21/00* (2006.01)

(52) U.S. Cl. ..... 81/57.39; 81/57.13

(58) Field of Classification Search ..... 81/57.11, 81/57.13, 57.29, 57.39
See application file for complete search history.

(56) References Cited

U.S. PATENT DOCUMENTS

| | | | | |
|---|---|---|---|---|
| 4,974,475 | A * | 12/1990 | Lord et al. | 81/57.13 |
| 6,915,721 | B2 * | 7/2005 | Hsu et al. | 81/57.13 |
| 7,080,578 | B2 * | 7/2006 | Izumisawa | 81/57.39 |
| 7,413,025 | B2 * | 8/2008 | Provost | 173/29 |
| 7,475,609 | B2 * | 1/2009 | Liaw | 74/116 |

* cited by examiner

*Primary Examiner* — David B Thomas
(74) *Attorney, Agent, or Firm* — Hershkovita & Associates, LLC; Abraham Hershkovitz

(57) ABSTRACT

A power ratchet assembly has a handle, a power shaft, a sleeve, a crankshaft, multiple planet gears, multiple pins, two support bearings and a ratchet head device. The crankshaft has an outer surface. The support bearings are securely mounted around the outer surface of the crankshaft. Because the crankshaft is supported by the support bearings, the crankshaft is effectively stabilized so mitigating vibration of the crankshaft and reducing wear of the planet gears and noise and increasing useful life of the power ratchet assembly.

4 Claims, 5 Drawing Sheets

POWER RATCHET ASSEMBLY

BACKGROUND OF THE INVENTION

1. Field of the Invention

The present invention relates to a power ratchet assembly, and more particularly to a power ratchet assembly with stabilized crankshaft.

2. Description of Related Art

With reference to FIGS. 4 to 5, a conventional power ratchet assembly comprises a handle (A), a power shaft (B), a sleeve (C), a crankshaft (D), a disc (E), multiple planet gears (F) and a ratchet head device (G).

The handle (A) is hollow and cylindrical and has one end and a recess (A1). The recess (A1) is axially defined in the end of the handle (A) and has an inner surface and a bottom. The power shaft (B) is axially and rotatably mounted in the recess (A1). The sleeve (C) is securely mounted in the inner surface of the recess (A1) and has an inner surface and an inside space.

The crankshaft (D) is cylindrical, is rotatably mounted in the sleeve (C) and has two ends, an outer surface, an engaging section (D1) and an eccentric rod (D3). The engaging section (D1) is defined around the outer surface at one end of the crankshaft (D) and is mounted in the inside space of the sleeve (C). The eccentric rod (D3) eccentrically protrudes from the other end of the crankshaft (40) and out of the recess (A1) of the handle (A).

The disc (E) is mounted around and engages the engaging section (D1), is mounted in the inside space of the sleeve (C) and has an end and multiple pins (E1). The pins (E1) protrude from the end of the disc (E) at intervals and face the bottom of the recess (A1).

The planet gears (F) are respectively and rotatably mounted around the pins (E1). Each planet gear (F) engages the inner surface of the sleeve (C) and the power shaft (B).

The ratchet head device (G) is mounted securely around the sleeve (C), abuts the end of the handle (A) and has a head (G1) and a connecting bearing (G2). The head (G1) has an inner surface. The connecting bearing (G2) is a needle roller bearing, is securely mounted in the inner surface of the head (G1) and around the crankshaft (D) between the eccentric rod (D3) and the disc (E).

However, the conventional power ratchet assembly has some drawbacks as follows:

1. Strong Vibration of the Crankshaft (D):

The crankshaft (D) is supported simply by the connecting bearing (G2). While rotating, the crankshaft (D) will strongly vibrate because of insufficient support. Consequently, the vibrating crankshaft (D) will cause the disc (E), the pins (E1) and the planet gears (F) to vibrate. Vibration causes the planet gears (F) to wear easily, makes noise and also decreases the useful life of the power ratchet assembly.

2. Accumulated Tolerance and Concentricity Tolerance.

The crankshaft (D) and the disc (E) are two individual parts and need to be combined. Therefore, accumulated tolerance and concentricity tolerance between the crankshaft (D) and the disc (E) will occur to cause vibration therebetween. This can not stabilize the crankshaft (D) and decreases useful life of the ratchet assembly.

To overcome the shortcomings, the present invention tends to provide a power ratchet assembly to militate the aforementioned problems.

SUMMARY OF THE INVENTION

The main objective of the invention is to provide a power ratchet assembly with stabilized crankshaft.

A power ratchet assembly has a handle, a power shaft, a sleeve, a crankshaft, multiple planet gears, multiple pins, two support bearings and a ratchet head device. The crankshaft has an outer surface. The support bearings are securely mounted around the outer surface of the crankshaft. Because the crankshaft is supported by the support bearings, the crankshaft is effectively stabilized so mitigating vibration of the crankshaft and reducing wear of the planet gears, noise and increasing useful life of the power ratchet assembly.

Other objects, advantages and novel features of the invention will become more apparent from the following detailed description when taken in conjunction with the accompanying drawings.

DETAILED DESCRIPTION OF PREFERRED EMBODIMENT

Figure 1:
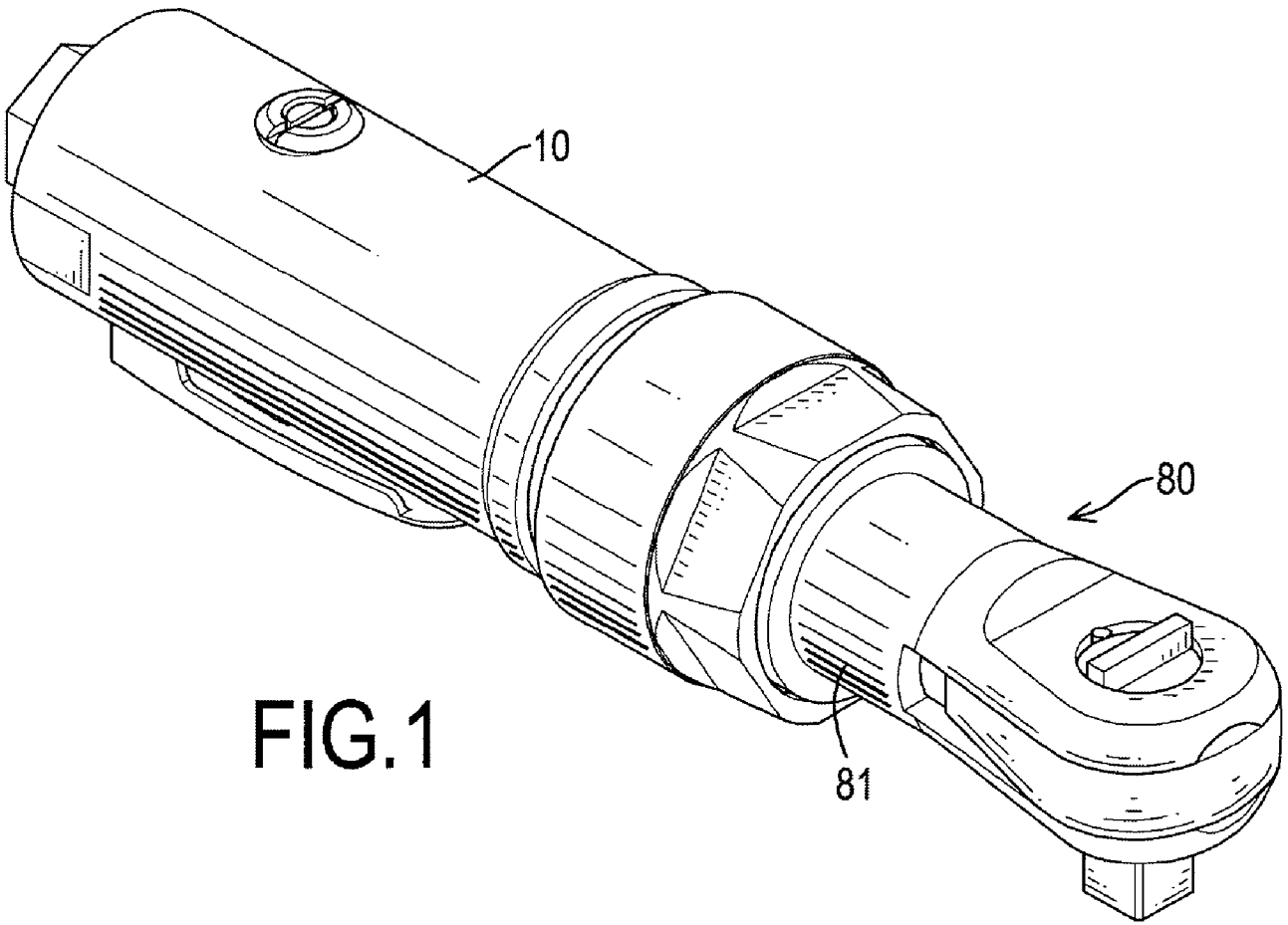
FIG. 1 is a perspective view of a power ratchet assembly in accordance with the present invention.
Figure 2:
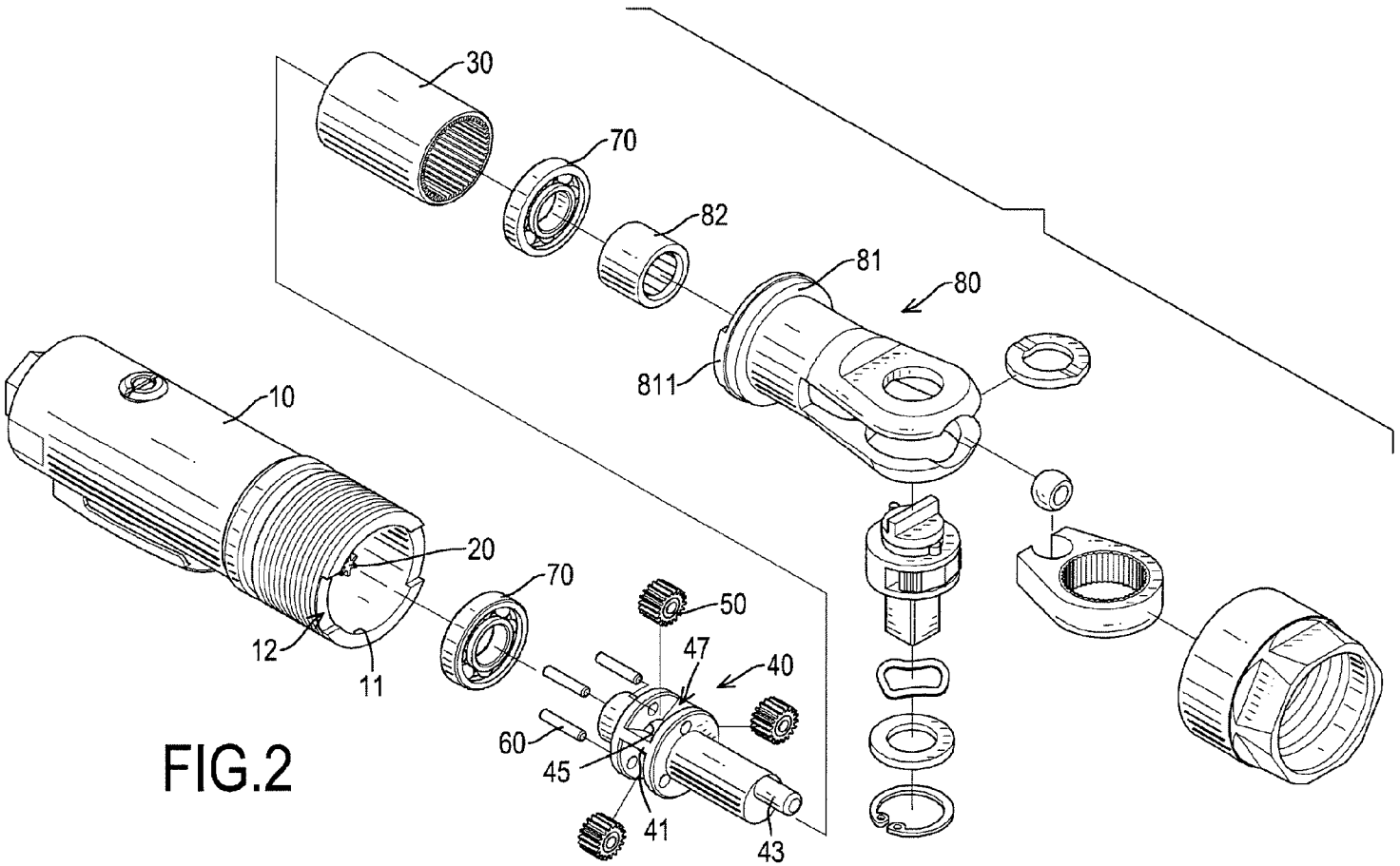
FIG. 2 is an exploded perspective view in partial section of the power ratchet assembly in FIG. 1.
Figure 3:
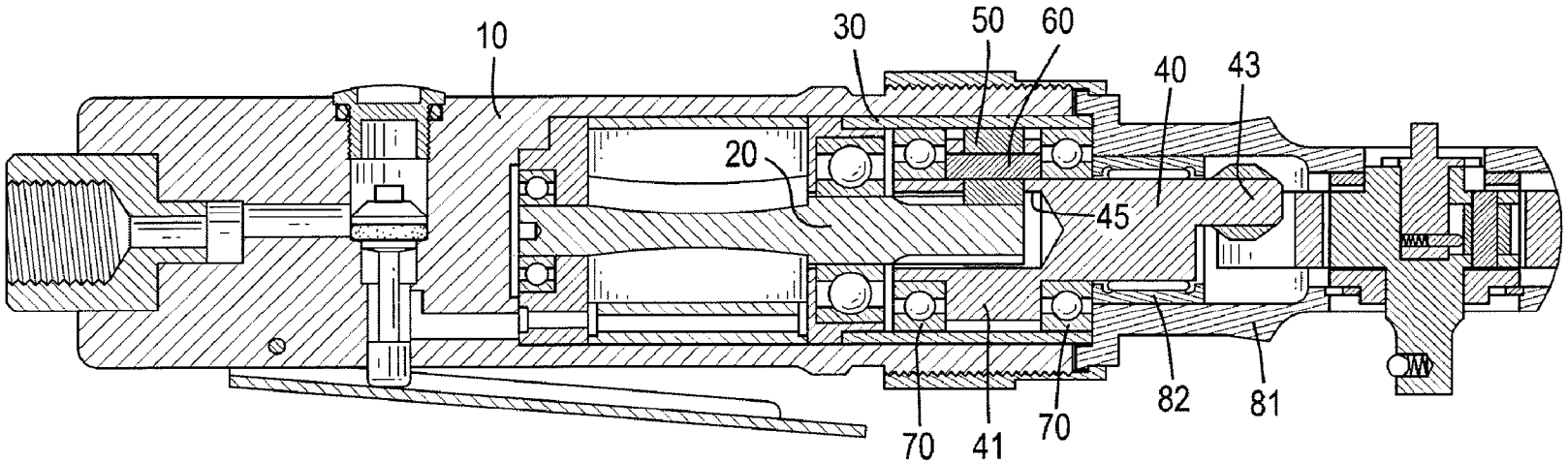
FIG. 3 is a side view in partial section of the power ratchet assembly in FIG. 1.
Figure 4:
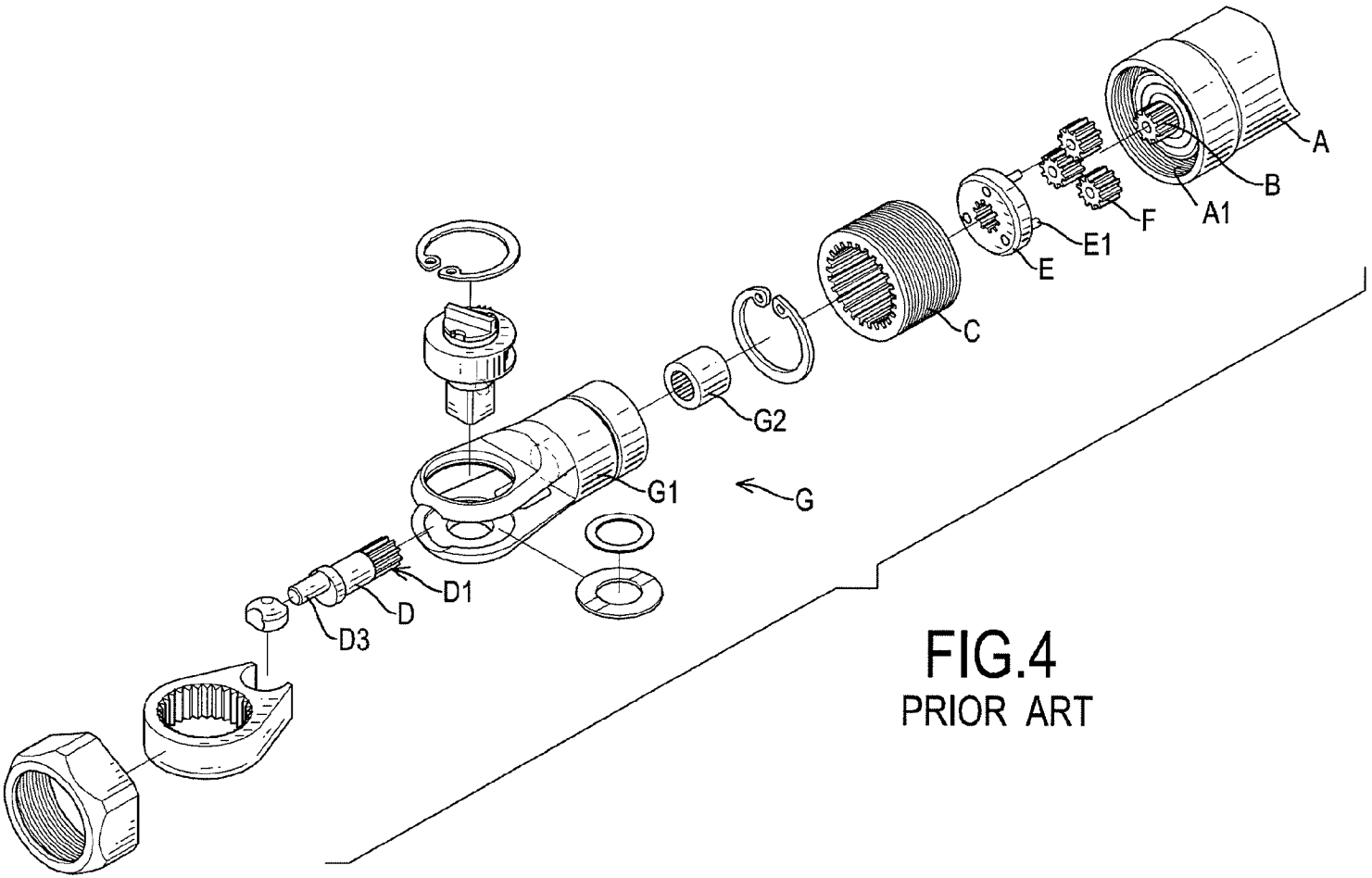
FIG.4 PRIOR ART
FIG. 4 is an exploded perspective view of a conventional power ratchet assembly in accordance with the prior art.
Figure 5:
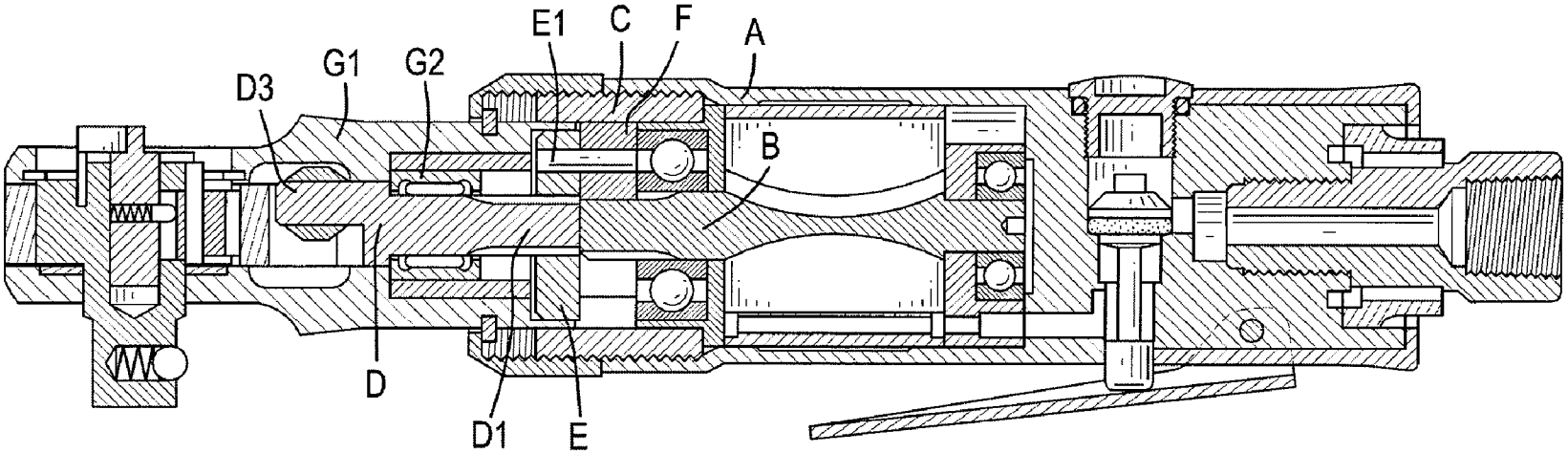
FIG.5 PRIOR ART
FIG. 5 is a side view in partial section of the power ratchet assembly in FIG. 4.

With reference to FIGS. 1 to 3, a power ratchet assembly comprises a handle (10), a power shaft (20), a sleeve (30), a crankshaft (40), multiple planet gears (50), multiple pins (60), two balance bearings (70) and a ratchet head device (80).

The handle (10) is hollow and cylindrical and has one end, a diameter, a recess (11) and two slots (12). The recess (11) is axially defined in the end of the handle (10) and has an inner surface. The slots (12) are diametrically defined in the end of the handle (10) beside the recess (11) and communicate with the recess (11).

The power shaft (20) is axially and rotatably mounted in the recess (11).

The sleeve (30) is securely mounted in the inner surface of the recess (11) and has an inside space and an inner surface. The handle (10), the power shaft (20) and the sleeve (30) may be conventional, so detailed description is omitted.

The crankshaft (40) is cylindrical, is rotatably mounted through the sleeve (30) and has two ends, an outer surface, a disc section (41), an eccentric rod (43), a shaft hole (45) and multiple gear openings (47).

The disc section (41) is round, is mounted in the inside space of the sleeve (30), radially protrudes from the outer surface of the crankshaft (40) and has two sides.

The eccentric rod (43) protrudes eccentrically from one end of the crankshaft (40) and out of the recess (11) of the handle (10).

The shaft hole (45) is round and is axially defined in the other end of the crankshaft (40). The power shaft (20) protrudes into the shaft hole (45).

The gear openings (47) are radially defined in the outer surface of the crankshaft (40) at intervals, may be defined in the disc section (41) and communicate with the shaft hole (45). Preferably, three gear openings (47) are implemented.

The planet gears (50) are respectively and rotatably mounted in the gear openings (47). Each planet gear (50)

protrudes from a corresponding gear opening (47) and engages the inner surface of the sleeve (30) and the power shaft (20).

The pins (60) are mounted in the disc section (41) and are respectively and axially mounted through the planet gears (50).

The support bearings (70) are securely mounted around the crankshaft (40) and are securely mounted in the inner surface of the sleeve (30). The support bearings (70) respectively face and abut the sides of the disc section (41). Preferably, each support bearing (70) is a ball bearing.

The ratchet head device (80) is mounted securely on the end of the handle (10) and has a head (81) and a connecting bearing (82). The head (81) has one end, an inner surface and two protrusions (811). The two protrusions (811) are formed on and protrude from the end of the head (81) and are respectively inserted into the slots (12).

The connecting bearing (82) is securely mounted in the inner surface of the head (81) and around the crankshaft (40) between the eccentric rod (43) and a corresponding support bearing (70). Preferably, the connecting bearing (82) is a needle roller bearing. The ratchet head device (80) may be conventional, so detailed description is omitted.

From the above description, it is noted that the present invention has the following advantages:

1. Stabilization of the Crankshaft (40):

The crankshaft (40) is supported by the support bearings (70). While rotating, the support bearings (70) will effectively stabilize the crankshaft (40) to prevent vibration so reducing wear of the planet gears (50) and noise and increasing useful life of the power ratchet assembly.

2. Strengthened Structure and Long Life:

The crankshaft (40) and the disc section (41) are combined as an individual single part, so accumulated tolerance, concentricity tolerance and vibration between the crankshaft (40) and the disc section (41) can be avoided.

3. Stabilization of the Ratchet Head Device (80):

Because the protrusions (811) of the head (81) are inserted into the slots (12) of the handle (10), the ratchet head device (80) can be stabilized and relative rotation between the head (81) and the handle (10) will be obviated.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power ratchet assembly comprising:

a handle having one end; and a recess axially defined in the end of the handle and having an inner surface;

a power shaft axially and rotatably mounted in the recess;

a sleeve securely mounted in the inner surface of the recess and having an inside space and an inner surface;

a crankshaft rotatably mounted through the sleeve and having two ends;

an outer surface;

a round disc section mounted in the inside space of the sleeve, radially protruding from the outer surface of the crankshaft and having two sides;

an eccentric rod eccentrically protruding from one end of the crankshaft and out of the recess of the handle;

a shaft hole axially defined in the other end of the crankshaft and surrounding the power shaft; and multiple gear openings radially defined in the disc section at intervals and respectively communicating with the shaft hole;

multiple planet gears respectively and rotatably mounted in the gear openings, each planet gear protruding from a corresponding gear opening and engaging the inner surface of the sleeve and the power shaft;

multiple pins mounted in the disc section and respectively and axially mounted through the planet gears;

two support bearings securely mounted around the crankshaft, securely mounted in the inner surface of the sleeve and respectively facing the sides of the disc section; and a ratchet head device mounted securely on the end of the handle and having a head having an inner surface; and a connecting bearing securely mounted in the inner surface of the head and around the crankshaft between the eccentric rod and a corresponding support bearing.

2. The power ratchet assembly as claimed in claim 1, wherein each support bearing is a ball bearing.

3. The power ratchet assembly as claimed in claim 1, wherein the handle has a diameter and two slots which are diametrically defined in the end of the handle beside the recess and communicate with the recess; and the head has one end and two protrusions which are formed on and protrude from the end of the head and are respectively inserted into the slots.

4. The power ratchet assembly as claimed in claim 2, wherein the handle has a diameter and two slots which are diametrically defined in the end of the handle beside the recess and communicate with the recess; and the head has one end and two protrusions which are formed on and protrude from the end of the head and are respectively inserted into the slots.

* * * * *